US008116672B2

(12) United States Patent
Tamemasa

(10) Patent No.: US 8,116,672 B2
(45) Date of Patent: Feb. 14, 2012

(54) IMAGE FIXING DEVICE AND IMAGE FORMING APPARATUS

(75) Inventor: Hiroshi Tamemasa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 99 days.

(21) Appl. No.: 12/628,626

(22) Filed: Dec. 1, 2009

(65) Prior Publication Data

US 2010/0329754 A1 Dec. 30, 2010

(30) Foreign Application Priority Data

Jun. 26, 2009 (JP) ..... 2009-152861

(51) Int. Cl.
*G03G 15/20* (2006.01)

(52) U.S. Cl. ..... 399/333; 399/329

(58) Field of Classification Search ..... 399/328, 399/329, 330, 333, 335
See application file for complete search history.

(56) References Cited

U.S. PATENT DOCUMENTS 6,795,678 B2 * 9/2004 Yura et al. ..... 399/329
2005/0281595 A1 12/2005 Kachi
2006/0076345 A1 4/2006 Yamano
2007/0242990 A1 10/2007 Ohhara et al.
2008/0124111 A1 * 5/2008 Baba et al. ..... 399/69

FOREIGN PATENT DOCUMENTS

| | | |
|---|---|---|
| JP | A-2004-246240 | 9/2004 |
| JP | A-2006-047988 | 2/2006 |
| JP | A-2006-084648 | 3/2006 |
| JP | A-2006-106558 | 4/2006 |
| JP | A-2006-308932 | 11/2006 |
| JP | A-2007-286407 | 11/2007 |

* cited by examiner

*Primary Examiner* — Sandra Brase
(74) *Attorney, Agent, or Firm* — Oliff & Berridge, PLC

(57) ABSTRACT

The invention provides an image fixing device containing a tubular formed first rotating body rotatable in a circumferential direction, a second rotating body that is arranged so that an outer circumferential surface of the second rotating body is in contact with an outer circumferential surface of the first rotating body, a heating unit that heats the first rotating body; and a heating auxiliary member that is arranged to be in contact with an inner circumferential surface of the first rotating body, at least a surface of the heating auxiliary member that is in contact with the inner circumferential surface of the first rotating body being made of a porous metal.

18 Claims, 5 Drawing Sheets

IMAGE FIXING DEVICE AND IMAGE FORMING APPARATUS

CROSS-REFERENCE TO RELATED APPLICATION

This application is based on and claims priority under 35 USC 119 from Japanese Patent Application No. 2009-152861, filed on Jun. 26, 2009.

BACKGROUND

1. Technical Field

The present invention relates to an image fixing device, and an image forming apparatus.

2. Related Art

An image fixing device has been suggested wherein an electromagnetic induction heating mode is adopted. This image fixing device, in an electromagnetic induction heating mode, is an apparatus wherein a magnetic field generated by an induction coil is caused to act onto a rotating body having an electroconductive layer (heat generating layer) so that the rotating body is directly heated by an eddy current generated in the electroconductive layer.

SUMMARY

According to an aspect of the invention, there is provided an image fixing device containing:

a tubular formed first rotating body rotatable in a circumferential direction;

a second rotating body that is arranged so that an outer circumferential surface of the second rotating body is in contact with an outer circumferential surface of the first rotating body;

a heating unit that heats the first rotating body; and a heating auxiliary member that is arranged to be in contact with an inner circumferential surface of the first rotating body, at least a surface of the heating auxiliary member that is in contact with the inner circumferential surface of the first rotating body being made of a porous metal.

BRIEF DESCRIPTION OF THE DRAWINGS

Exemplary embodiments of the invention will be described in detail based on the following figures, wherein.

DETAILED DESCRIPTION

With reference to the drawings, exemplary embodiments of the present invention will be described hereinafter. To members having substantially the same function, the same reference numbers are attached throughout all the drawings, and overlapping description therefor is appropriately omitted.

A heating auxiliary member contacting the inner circumferential surface of a fixing belt has an aspect of restraining a fall in the temperature of the fixing belt, while also having another aspect of hindering the rotation of the fixing belt by sliding-resistance generated therebetween since the member has a large contact area with the fixing belt.

Figure 1:
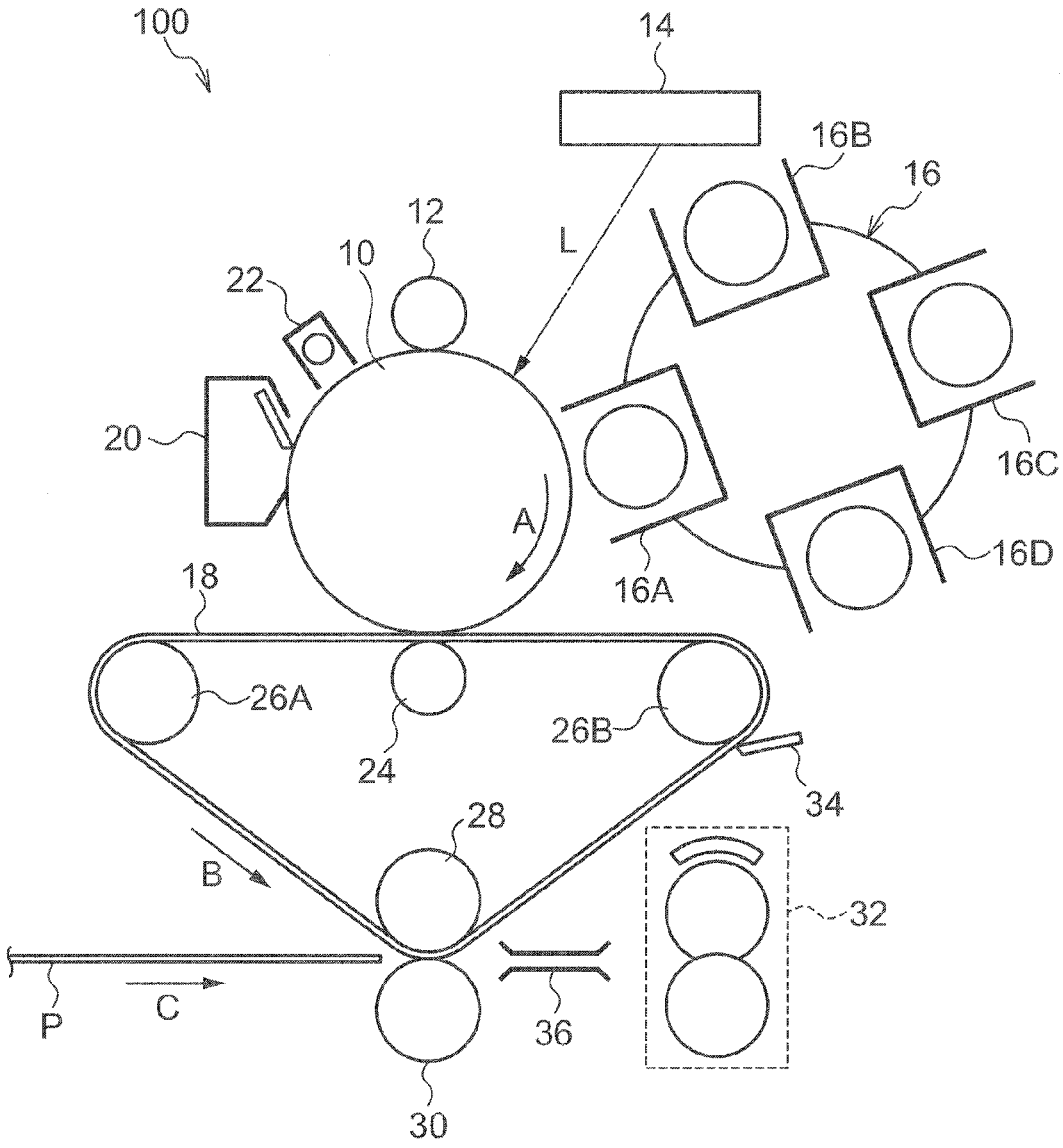
FIG. 1 is a schematic view illustrating the structure of an image forming apparatus according to one of the exemplary embodiments.
Figure 2:
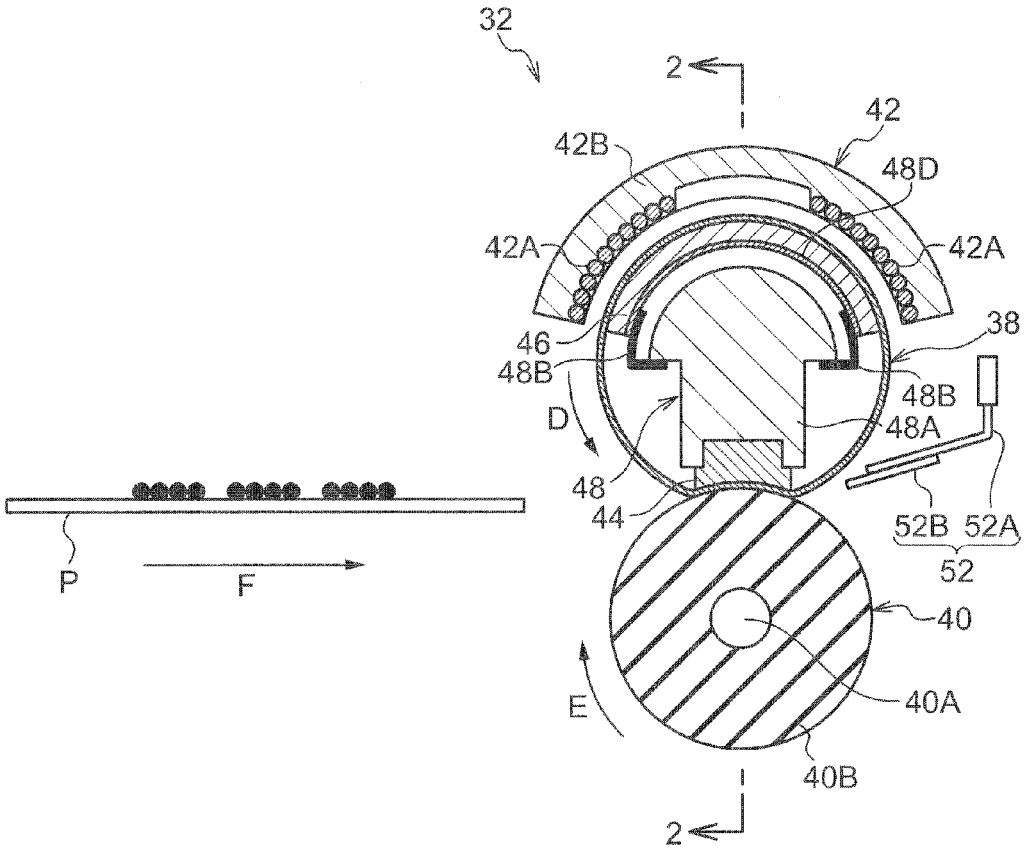
FIG. 2 is a schematic view illustrating a cross section of a rotating body of an image fixing device according to one of the exemplary embodiments, the cross section being one perpendicular to the axial direction of the rotating body.
Figure 3:
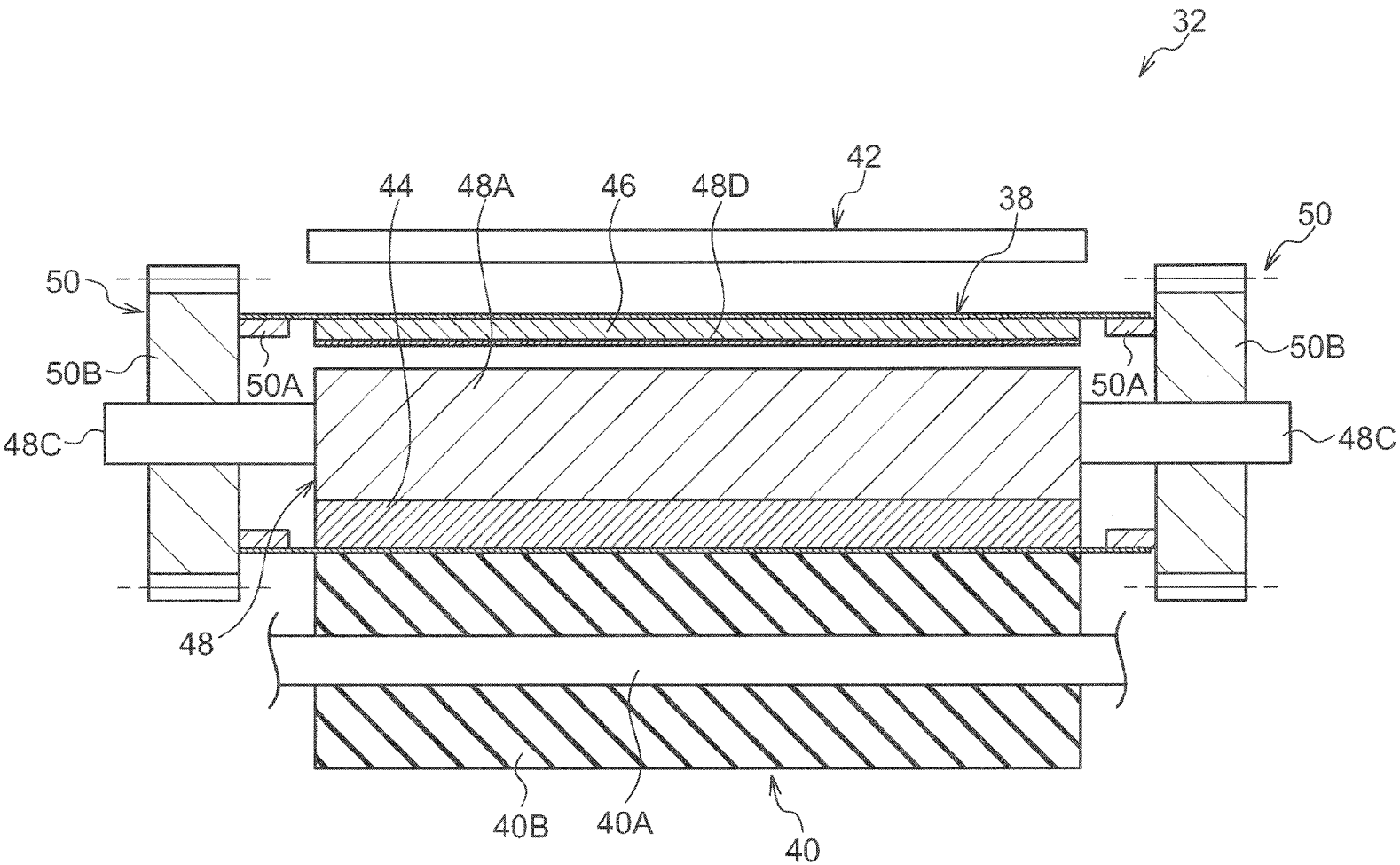
FIG. 3 is a schematic view illustrating a cross section of the rotating body of the image fixing device according to the present exemplary embodiment, the cross section being one along the axial direction of the rotating body (cross section taken on line 2-2 in FIG. 2)

FIG. 1 shows an image forming apparatus, equipped with an image fixing device, according to an exemplary embodiment of the invention. FIG. 2 shows a schematic view illustrating a cross section of a rotating body in the image fixing device, which is according to an exemplary embodiment of the invention, the cross section being perpendicular to the axial direction of the rotating body, and FIG. 3 shows a schematic view illustrating a cross section of the rotating body of the image fixing device according to the present exemplary embodiment, the cross section being along the axial direction of the rotating body.

As illustrated in FIG. 1, an image forming apparatus 100 according to the present exemplary embodiment is equipped with a cylindrical photoreceptor 10 (image holding member) rotatable in one direction (direction represented by arrow A in FIG. 1). Around this photoreceptor 10, from the upstream side of the photoreceptor 10 in the rotating direction thereof, the following are successively arranged: a charging device 12 for charging the surface of the photoreceptor 10; an exposing device 14 (latent image forming unit) that irradiates image-wise light L to the photoreceptor 10 so as to form a latent image on the surface of the photoreceptor 10; a developing device 16 (developing unit) including developing members 16A, 16B, 16C and 16D, which are each a member for transferring a developing agent containing a toner selectively onto the latent image on the surface of the photoreceptor 10 to form a toner image; an intermediate transfer medium 18, in an endless belt form, onto which the toner image formed on the surface of the photoreceptor 10 is temporarily transferred (primarily transferred), the intermediate transfer medium 18 being arranged to be opposed to the photoreceptor 10; a cleaning device 20 that removes toner that remains on the surface of the photoreceptor 10 after the toner image is transferred; and an erasing exposing device 22 that erases the surface of the photoreceptor 10.

Inside the intermediate transfer medium 18, there are arranged a transferring device 24 for primarily transferring a toner image formed on the surface of the photoreceptor 10 onto the intermediate transfer medium 18, two supporting rolls 26A and 26B, and a transferring opposed roll 28 for conducting secondary transfer. The intermediate transfer medium 18 is stretched over these rolls so as to be rotated and carried in one direction (direction represented by arrow B in FIG. 1) by the rolls. At a position opposite to the transferring opposed roll 28 via the intermediate transfer medium 18, a transferring roll 30 is arranged. The transferring roll 30 is a roll for secondarily transferring the toner image transferred primarily onto the outer circumferential surface of the intermediate transfer medium 18 onto a recording paper sheet (recording medium) P. The recording paper sheet P is sent, along a direction represented by arrow C, into a pressuring portion between the transferring opposed roll 28 and the transferring roll 30. The recording paper sheet P, onto the surface of which the toner image is secondarily transferred at the pressuring portion, is carried, as it is, in the arrow C direction.

At the downstream side of the rolls 28 and 30 in the direction in which the recording paper sheet P is carried (arrow C direction), an image fixing device 32 (fixing unit, which may be hereinafter referred to as a "fixing device" as the case may be) is arranged for fixing the toner image on the surface of the recording paper sheet P by heating and melting. The recording paper sheet P is sent via a paper sheet guiding member 36 to the fixing device 32. At the downstream side of the rolls 28 and 30 in the rotating direction (arrow B direction) of the intermediate transfer medium 18, a cleaning device 34 is arranged for removing toner that remains on the surface of the intermediate transfer medium 18.

Next, the fixing device according to the present exemplary embodiment will be explained.

As illustrated in FIGS. 2 and 3, the fixing device 32 according to the present exemplary embodiment is equipped with: an endless fixing belt 38 (cylindrical first rotating body) rotatable in one direction (direction represented by arrow D); a pressuring roll 40 (second rotating body) rotatable in one direction (direction represented by arrow E) and arranged in such a manner that its outer circumferential surface is in contact with the outer circumferential surface of the fixing belt 38; and a magnetic field generating device 42 (heating unit) arranged at a position opposite to the face of the fixing belt 38 contacting with the pressuring roll 40 with respect to the fixing belt 38, and placed so as to be separated from the fixing belt 38.

The fixing belt 38 has, on the inner circumferential side thereof, a fixing member 44 for pushing the fixing belt 38 onto the pressuring roll 40 to form a contacting portion, a heat generator 46 (heating auxiliary member) arranged at a position opposite to the magnetic field generating device 42 via the fixing belt 38 and arranged so as to be in contact with the inner circumferential surface of the fixing belt 38, and a supporting member 48 for supporting the fixing member 44.

The fixing belt 38 is supported by the supporting member 48. As illustrated in FIG. 3, at both end portions of the fixing belt 38, driving force transmitting members 50 are arranged for transmitting rotating driving force to drive and rotate the fixing belt 38.

At the downstream side of the contacting portion between the fixing belt 38 and the pressuring roll 40 in the carrying direction of the recording paper sheet P (direction represented by arrow F), a peeling member 52 is arranged. The peeling member 52 is composed of a supporting portion 52A one end of which is supported and fixed, and a peeling sheet 52B supported by the supporting portion 52A. The front end of the peeling sheet 52B is arranged so as to be close to the fixing belt 38 or in contact therewith.

First, the fixing belt 38 (first rotating body) will be explained. The fixing belt 38 is, for example, a belt having a thickness of 30 to 150 μm (preferably 50 to 150 μm, more preferably 100 to 150 μm) and made of a metal (such as stainless steel, a soft magnetic material (such as permalloy, or Sendust), or a hard magnetic material (metal such as Fe—Ni—Co alloy and Fe—Cr—Co alloy)). In the case of using a heating unit other than any electromagnetic induction heating mode, for example, a halogen lamp, the fixing belt 38 may be a resin belt (such as a polyimide belt) having a thickness of for example, 50 to 150 μm. The belt 38 may be a belt wherein a surface releasing layer (such as a fluorine-based resin layer) having a thickness of, for example, 1 to 30 μm is formed on the outer circumferential surface of a substrate that is any one of these metal belts and the resin belt.

In particular, the fixing belt 38 is advantageous a belt having a heat generating layer containing a nonmagnetic metallic material that generates heat by itself by the influence of the magnetic field. Specifically, the belt may be a belt having a heat generating layer having a thickness of, for example, 2 to 20 μm (preferably 5 to 10 μm) and made of a metal (such as copper, aluminum or silver). The fixing belt 38 may be a belt wherein a surface releasing layer (such as a fluorine-based resin layer) having a thickness of, for example, 1 to 30 μm is formed on the outer circumferential surface of a heat generating layer, or may be a belt wherein a heat generating layer is interposed between two substrates, specifically, a belt wherein a heat generating layer (such as a copper layer) is interposed between two stainless steel substrates.

Between the substrate and the surface releasing layer, an elastic layer containing silicone rubber, fluorine-based rubber, fluorosilicone rubber or the like may be formed.

It is advantageous that the fixing belt 38 is formed to have a small thermal capacity (of, for example, 5 to 60 J/K, preferably 30 J/K or less), for example, by making the thickness thereof small, or selecting the constituting material thereof.

The diameter of the fixing belt 38 is, for example, from 20 to 50 mm.

Next, the pressuring roll 40 (second rotating body) will be explained. The pressuring roll 40 is supported by spring members (not illustrated) at its both ends, and arranged to be pressured via the fixing belt 38 onto the fixing member 44 at a total load of, for example, 294 N (30 kgf). When preliminary heating (heating until a toner image attains a state such that the image is fixed onto the recording medium) is conducted, the pressuring roll 40 is shifted so as to be separated from the fixing belt 38.

The pressuring roll 40 is, for example, a roll having a cylindrical metallic core material 40A, and an elastic layer 40B (such as a silicone rubber layer or a fluorine-based rubber layer) formed on the surface of the core material 40A. If necessary, a surface releasing layer (such as a fluorine-based resin layer) may be formed on the outermost surface of the pressuring roll 40.

Figure 4:
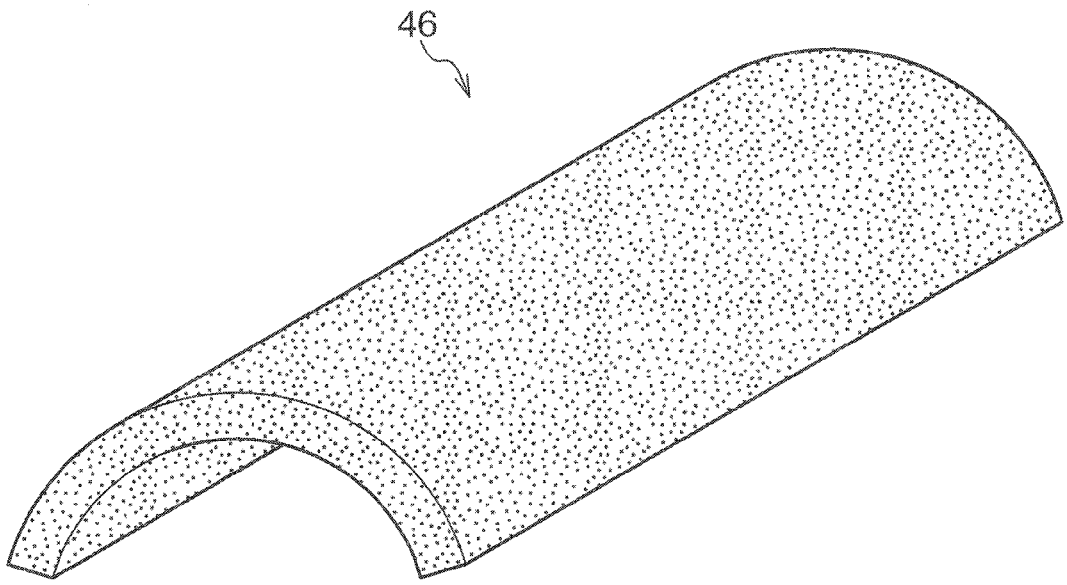
FIG. 4 is a schematic view illustrating an example (monolayered structure) of a heating auxiliary member.

Next, the heat generator 46 (heating auxiliary member) will be explained. FIG. 4 illustrates the heat generator 46 according to the present exemplary embodiment. The heat generator 46 is held by a holding member 48D constituting the supporting member 48. The heat generator 46 is formed to have a shape following the inner circumferential surface of the fixing belt 38, and is arranged to be in contact with the inner circumferential surface of the fixing belt 38 and be further opposed to the magnetic field generating device 42 via the fixing belt 38.

The heat generator 46 contacts the inner circumferential surface of the fixing belt 38 in this way, and is electromagnetically induced by the influence of the magnetic field generated from the magnetic field generating device 42 to generate heat. Thus, the heat generator 46 performs the role of heating the belt 38 subsidiarily from the inside thereof while the heat generator 46 supports the fixing belt 38 from the inner circumferential surface side to contribute to smooth rotation thereof.

This heat generator 46 is made of a porous metal. Since the heat generator 46 is made of a porous metal, this member has a higher performance of retaining a lubricant (oil) as compared with a heat generator made of a metal having no pores (hereinafter referred to as a "nonporous metal" or "bulk metal"), whereby a rise in the sliding-resistance between the fixing belt 38 and the heat generator 46 is restrained over a long term.

The lubricant is not particularly limited as far as it is a lubricant that is not denatured by heat generated from the heat generator 46 and has an effect of lowering the sliding-resistance between the fixing belt 38 and the heat generator 46. For example, a silicone-based or a fluorine-based heat-resistant oil is used.

Examples of the silicone-based oil include a methylphenyl silicone oil (trade name: KF-54) manufactured by Shin-Etsu Chemical Co., Ltd., and dimethylsilicone oils (trade names: KF-965 and KF-968) manufactured by Shin-Etsu Chemical Co., Ltd. Examples of the fluorine-based oil include oils (trade names: DEMNAM S-200, DEMNAM S-20, DEMNAM S-65, and DAIFLOIL) manufactured by Daikin Industries, Ltd.

The porous metal, which constitutes the heat generator 46, is preferably a metal sintered body from the viewpoints of lubricant-retaining performance, mechanical strength, easiness of production, and the like.

The method for producing the heat generator 46 made of a metal-sintered body involves, for example, filling metallic particles into a mold having a specific shape, forming by pressing, and then sintering the formed particles. According to this method, a porous heat generator wherein voids are made between the metallic particles is easily produced.

The metal of the metallic particles constituting the sintered body (heat generator 46) is, for example, a thermosensitive magnetic metal, wherein an induced current ceases to flow when the temperature of the metal becomes the Curie temperature or higher. This magnetic metallic material is, for example, a ferromagnetic material having a relative magnetic permeability of 100 or more or about 100 or more, and preferably 500 or more or about 500 or more. Specific examples thereof include Fe, Ni, and Fe—Ni. The heat generator 46 made of the sintered body of the metallic particles generates heat by an electromagnetic induction effect of a magnetic field, and the heat is accumulated inside of the heat generator 46.

The size of the metal particles is, for example, 0.5 μm or about 0.5 μm to 20 μm or about 20 μm. The size of the metal particles is a value obtained by measuring the particles with a laser diffraction particle size analyzer.

The sintered density of the sintered body constituting the heat generator 46 is preferably 30% or about 30% to 95% or about 95%. The sintered density refers to the ratio by weight of the sintered body per unit volume relative to a dense metallic body (bulk metal) made of the metal that constitutes the sintered body. For example, a sintered body having a sintered density of 40% means that 60% of the volume thereof is hollow. The sintered density can be obtained by calculating using the following equation based on the measurement of the weight of the sintered body.

$$\text{Sintered density}(\%)=(\text{weight per unit volume of the sintered body}/\text{weight per unit volume of the metal that constitutes the sintered body})\times 100$$

When the sintered density of the sintered body constituting the heat generator 46 is 30% or about 30% to 95% or about 95%, the heat generator 46 retains a lubricant sufficiently, and further has strength for supporting the fixing belt 38. From these viewpoints, the sintered density of the sintered body constituting the heat generator 46 is more preferably 40% or about 40% to 80% or about 80%, and particularly preferably 50% or about 50% to 70% or about 70%.

Figure 5:
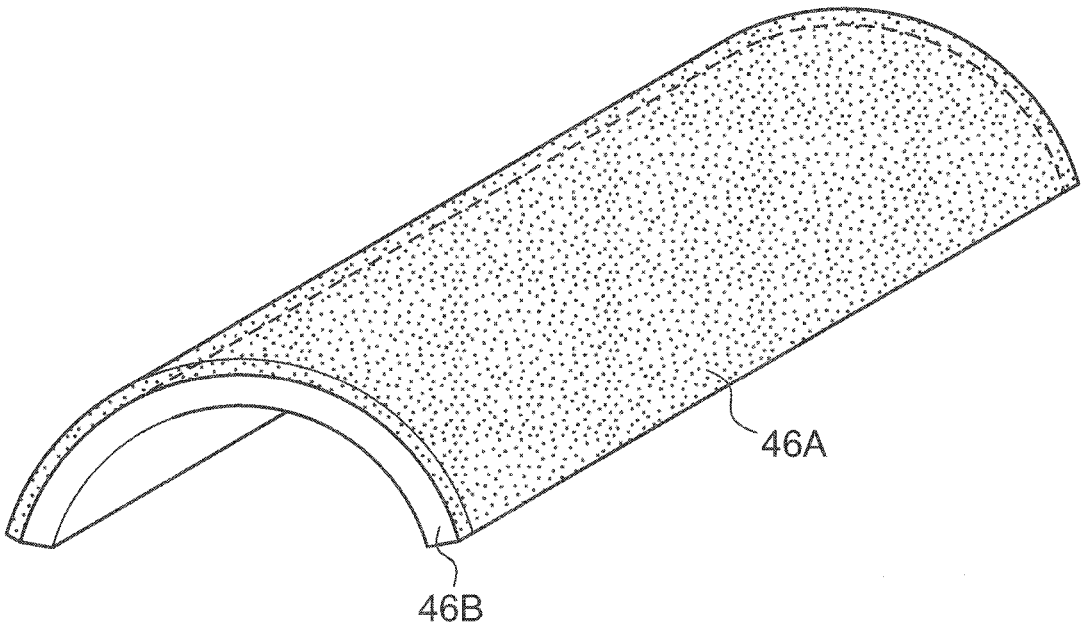
FIG. 5 is a schematic view illustrating another example (bilayered layer) of the heating auxiliary member.

A heat generator may be used as the heat generator 46 according to the present exemplary embodiment as long as at least its surface that contacts the inner circumferential surface of the fixing belt 38 is made of a porous metal. For example, the heat generator 46 may be a laminate composed of a layer containing a porous metal and a layer containing a nonporous metal. As illustrated in FIG. 5, for example, a bilayered heat generator (clad material) wherein an upper layer 46A containing the surface which contacts the inner circumferential surface of the fixing belt 38 is made of a porous metal, and a lower layer 46B is made of a nonporous metal (bulk metal) may be used. In this case, the metal constituting the upper layer 46A and the lower layer 46B may be the same as or different from each other.

In the heat generator having such a laminated structure, a lubricant is effectively retained on the upper layer 46A, and effectively supplied into the gap between the fixing belt 38 and the heat generator 46 so that a rise in the sliding-resistance may be restrained to a lower value over a long term.

Next, the fixing member 44 will be explained. The fixing member 44 is, for example, a rodlike member having an axial line along the axial direction (width direction) of the fixing belt 38, and is a member for resisting pressuring force acting from the pressuring roll 40. The pressuring roll 40 pressures through the fixing belt 38 onto the fixing member 44 to deform the fixing belt 38 toward the inner circumferential surface side thereof.

The material of the fixing member 44 is not particularly limited as long as the material is a material by which the flexure amount of a combination of this material with the supporting member 48 is at an allowable level or less when the combination receives pressuring force from the pressuring roll 40. Specifically, the material is, for example, a material wherein the flexure amount is about 0.5 mm or less. Examples of the material include elastic materials such as silicone rubber, and heat-resistant resins such as glass fiber reinforced PPS (polyphenylene sulfide), phenol, polyimide, and liquid crystal polymer.

Next, the supporting member 48 will be explained. The supporting member 48 has, for example, a supporting member body 48A, a spring member 48B for supporting a holding member 48D, a shaft 48C extended over the supporting member body 48A and both ends of the body 48A in the longitudinal direction thereof, and the holding member 48D for holding the heat generator 46.

The supporting member body 48A and the shaft 48C are each made of, for example, a metallic material, or a resin material. When the heat generator 46 is made of the above-mentioned thermosensitive magnetic material, the supporting member body 48A is made of a nonmagnetic metallic material (such as copper, aluminum or silver).

The spring member 48B is a member for connecting the holding member 48D and the supporting member body 48A to each other, and supports the heat generator 46 via the holding member 48D. The holding member 48D is arranged so as not in contact with the supporting member body 48A via the spring member 48B, and is arranged on the inner circumferential side of the fixing belt 38 such that the fixing belt 38 is maintained in a cylindrical form (tubular form) via the heat generator 46. The spring member 48B is connected to the holding member 48D at both ends of the holding member 48D in the width direction of the holding member 48D.

The spring member 48B may be, for example, a curved leaf spring (made of, for example, a metal). This spring member 48B holds the holding member 48D. Even when the fixing belt 38 is eccentrically rotated so that the fixing belt 38 is displaced in the radial direction thereof, the spring member 48B causes the heat generator 46 to follow the displacement so as to keep the state that the outer circumferential surface of the heat generator 46 contacts the inner circumferential surface of the fixing belt 38.

Next, the driving force transmitting members 50 will be explained. The driving force transmitting members 50 are each a member for transmitting driving force for automatically rotating the fixing belt 38, and are composed of; for example, flange portions 50A fitted into ends of the fixing belt 38, and cylindrical gear portions 50B having convexities and concavities on their outer circumferential surfaces. The driving force transmitting members 50 may be made of, for example, a metallic material, or a resin material.

The driving force transmitting members 50 are supported at the ends of the fixing belt 38 by fitting the flange portions 50A to the insides of the ends of the fixing belt 38. The gear portions 50B of the driving force transmitting members 50 are driven and rotated by a non-illustrated motor or the like, and further, the rotating driving force thereof is transmitted to the fixing belt 38 so that the belt 38 is automatically rotated.

In the present exemplary embodiment, the driving force transmitting members 50 are located at both ends of the fixing belt 38 in the axial direction of the belt 38. However, the invention is not limited thereto, and a driving force transmitting member 50 may be located at only one end of the fixing belt 38 in the axial direction thereof. The driving force transmitting members 50 are supported at the ends of the fixing belt 38 by fitting the flange portions 50A to the inside of the ends of the fixing belt 38. However, the invention is not limited thereto, and the driving force transmitting members 50 may be supported at the ends of the fixing belt 38 by fitting the ends of the fixing belt 38 to the insides of the flange portions 50A.

Next, the magnetic field generating device 42 will be explained. The magnetic field generating device 42 is formed to have a shape following the outer circumferential surface of the fixing belt 38, and is arranged to be opposed, via the fixing belt 38, to the heat generator 46 and to provide a gap of, for example, 1 to 3 mm between the magnetic field generating device 42 and the fixing belt 38. In the magnetic field generating device 42, exciting coils (magnetic field generating unit) 42A, which are wound plural times, are arranged along the axial direction of the fixing belt 38.

To these exciting coils 42A is connected an exciting circuit (not illustrated) for supplying an alternating current to the exciting coils 42A. Moreover, a magnetic material member 42B is arranged on the surface of the exciting coils 42A along the longitudinal direction (axial direction of the fixing belt 38).

The output from the magnetic field generating device 42 is performed in a range such that the heat generator 46 which is at a temperature lower than the Curie temperature is induced to generate heat by means of magnetic fluxes (magnetic field). Specifically, the range may be from 190 to 230° C.

Next, the operation of the image forming apparatus 100 according to the present exemplary embodiment will be explained.

First, the surface of the photoreceptor 10 is charged by the charging device 12. Next, from the exposing device 14, imagewise light L is irradiated to the photoreceptor 10 so that a latent image is formed on the surface of the photoreceptor 10 by an electrostatic potential difference. By rotating the photoreceptor 10 in the arrow A direction, the latent image is shifted at a position facing the developing member 16A, which is one developing member in the developing device 16. From the developing member 16A, a toner in a first color is transferred onto the latent image so that a toner image is formed on the surface of the photoreceptor 10. By rotating the photoreceptor 10 in the arrow A direction, the toner image is carried at a position facing the intermediate transfer medium 18. By the transferring device 24, the toner image is primarily transferred electrostatically onto the surface of the intermediate transfer medium 18.

Separately, toner that remains on the surface of the photoreceptor 10 after the primary transfer is removed by the cleaning device 20. The cleaned surface of the photoreceptor 10 is potentially initialized by the erasing exposing device 22. The initialized surface is again shifted at a position facing the charging device 12.

Thereafter, the developing members 16B, 16C and 16D, which are three developing members in the developing device 16, are successively shifted at the position facing the photoreceptor 10 to form toner images in second, third and fourth colors, respectively, in turn in the same way. In this way, when the four colors are unified, the images are transferred, in a lump, onto the surface of the intermediate transfer medium 18.

By a rotary shift of the intermediate transfer medium 18 in the arrow B direction, the unitary toner image on the intermediate transfer medium 18 is carried at a position where the transferring roll 30 and the transferring opposed roll 28 are opposed to each other, and then the toner image is brought into contact with the sent recording paper sheet P. A transferring voltage is applied between the transferring roll 30 and the intermediate transfer medium 18 so as to transfer the toner image secondarily onto the surface of the recording paper sheet P.

The recording paper sheet P on which the toner image, which is not yet fixed, being held is carried via the paper sheet guiding member 36 to the fixing device 32.

Next, the operation of the fixing device 32 according to the present exemplary embodiment will be explained.

First, in the fixing device 32, for example, a toner image forming operation is started in the image forming apparatus 100. Following the start, the driving force transmitting member 50 is driven and rotated by the non-illustrated motor (the start and the driving need not to be conducted strictly simultaneously) in the state that the fixing belt 38 and the pressuring roll 40 are separated from each other. Following the driving, the fixing belt 38 is driven and rotated at a circumferential speed of, for example, 200 mm/second in the arrow D direction.

The fixing belt 38 is driven and rotated, at the same time, an alternating current is supplied from the non-illustrated exciting circuit to the exciting coil 42A contained in the magnetic field generating device 42. When the alternating current is supplied to the exciting coil 42A, magnetic fluxes (magnetic field) are repeatedly generated and extinguished around the exciting coil 42A. When the fluxes (magnetic field) pass over the heat generator 46, an eddy current is generated in the heat generator 46 to generate a magnetic field which hinders a change in the magnetic field generated from the coil. Heat is then generated in proportion to the square of the intensity of the current flowing in the heat generator 46.

When the fixing belt 38 has a heat generating layer containing a nonmagnetic metallic material, the magnetic fluxes (magnetic field) penetrate through the fixing belt 38 and further the heat generating layer generates heat by the influence of the magnetic fluxes (magnetic field).

When the heat generator 46 is rubbed on the inner circumferential surface of the fixing belt 38, the heat generator 46 heats the fixing belt 38. Furthermore, from the heat generator 46, the lubricant with which the porous structure of the surface of the heat generator 46 is impregnated is supplied to the inner circumferential surface of the fixing belt 38 thoroughly so that the sliding-resistance between the heat generator 46 and the fixing belt 38 is reduced. Thus, a smooth rotation of the fixing belt 38 is maintained. In this way, the fixing belt 38 is heated to a setting temperature (for example, 150° C.) in, for example, about 10 seconds.

Next, in the state that the pressuring roll 40 is pressured onto the fixing belt 38, the recording paper sheet P conveyed in the fixing device 32 is further conveyed into the contacting portion between the fixing belt 38 and the pressuring roll 40 so as to be heated and pressured by the fixing belt 38 heated by the heat generator 46, which is a porous metal with which the heat-resistant oil is impregnated, and the pressuring roll 40. As a result, the toner image is melted and pressed onto the surface of the recording paper sheet P so as to be fixed on the recording paper sheet P.

When fixing is carried out by the fixing belt 38 and the pressuring roll 40, the heat generator 46 generates heat sufficiently and accumulates the heat. Therefore, even if the heat from the fixing belt 38 is consumed by the recording paper sheet P when the recording paper sheet P passes through the contacting portion between the fixing belt 38 and the pressuring roll 40, the heat generator 46 functions as a heat-accumulating member so that the heat from the heat generator 46 is shifted to the fixing belt 38.

When images are continuously fixed onto recording paper sheets P having a size which is, for example, smaller than the fixing region width (length in the axial direction) of the fixing belt 38, heat is consumed in the sheet carrying portion of the fixing belt 38 while no heat is consumed in the sheet non-carrying portion. For this reason, the temperature of the sheet non-carrying portion of the fixing belt 38 is raised.

However, when the heat generator 46 is made of a porous thermosensitive magnetic metal, the temperature of the heat generator 46 region contacting the sheet non-carrying region of the fixing belt 38, the temperature of which is raised, also rises. The temperature of the sheet non-carrying portion of the fixing belt 38 then reaches the Curie temperature of the thermosensitive magnetic metal powder, which constitutes the heat generator 46, so that the region of the heat generator 46 overlaid on (i.e., brought in contact with) the sheet non-carrying portion of the fixing belt 38 is non-magnetized so that the magnetic fluxes (magnetic field) penetrate through this region. In the region of the heat generator 46 through which the magnetic fluxes (magnetic field) penetrate in this manner, the magnetic fluxes (magnetic field) are disturbed so that the generation of the eddy current is restrained. Thus, a fall in the amount of the generated heat is caused.

When the supporting member body 48A, which is made of a nonmagnetic metallic material, is present, the magnetic fluxes (magnetic field) act onto the supporting member body 48A so that an eddy current flows mainly in the supporting member body 48A. Thus, the eddy current flowing in the fixing belt 38 is restrained. The magnetic fluxes (magnetic field) penetrating through the heat generator 46 are induced by the supporting member body 48A, which is made of the nonmagnetic metallic material, so as to be returned into the magnetic field generating device 42. Additionally, the supporting member body 48A is arranged not to be in contact with the heat generator 46. Thus, the heat in the fixing belt 38 is not transmitted to the heat generator 46.

When the toner image is fixed by the fixing belt 38 and the pressuring roll 40, the fixing belt 38 is rotated while the belt 38 is supported in the state of being in contact with the heat generator 46 arranged on the inner circumferential surface of the belt 38. While the sliding-resistance between the fixing belt 38 and the heat generator 46 is restrained with the lubricant interposed therebetween, the fixing belt 38 attains the fixation in the state of maintaining the cylindrical form thereof.

When the recording paper sheet P is conveyed out from the contacting portion between the fixing belt 38 and the pressuring roll 40, the sheet P is voluntarily caused to go straight by the rigidity thereof. Thus, the forward end of the sheet P is peeled from the wounded or bent fixing belt 38 so that the peeling member 52 (peeling sheet 52B) is squeezed into the gap between the forward end of the recording paper sheet P and the fixing belt 38. As a result, the recording paper sheet P is peeled from the surface of the fixing belt 38.

As described above, the toner image is formed on the recording paper sheet P, and fixed thereon.

EXAMPLES

The present invention will be more specifically described by examples hereinafter. However, the invention is never limited to the examples.

Example 1

Image Fixing Device

First, an image fixing device having the structure illustrated schematically in FIGS. 2 and 3 is prepared, and evaluations described below are made. As its individual members, the following are used:

Fixing belt: a belt having a diameter of 30 mm and a width of 360 mm, and composed of a polyimide substrate of 75 μm in thickness, a copper layer of 10 μm in thickness as a heat generating layer, and a PFA layer (PFA: copolymer of tetrafluoroethylene and perfluoroalkyl vinyl ether) of 30 μm in thickness as an outermost circumferential surface (heat-resisting temperature of the belt: about 250° C.);

Pressuring roll: an elastic roll having a diameter of about 30 mm and a width of 350 mm and having a structure wherein a stainless steel shaft of 20 mm in diameter is coated with an elastic layer of 5 mm in thickness made of a silicone rubber (rubber hardness: 30° according to JJS-A), and the layer is further covered with a PFA tube of 30 μm in thickness;

Heat generator: a Fe—Ni sintered body having a shape of a curved plate wherein from a cylinder of 30 mm in diameter with a thickness of 0.35 mm and a length of 310 mm, a portion corresponding to a central angle of 125° is cut out. The sintered body is impregnated with a silicon oil as a lubricant, and has a sintered density of 23%;

Lubricant: the silicone oil is methyl phenyl silicone oil (trade name: KF-54, manufactured by Shin-Etsu Chemical Co., Ltd.); and Supporting member body: a body made of aluminum.

An image fixing device having the above structure is prepared to conduct a fixing test.

Evaluation

Under conditions where the output of the used magnetic field generating device is set to 1000 W, the setting temperature is 175° C., and the process speed is 300 mm/s, recording paper sheets (size: B5, basis weight: 110 g/m$^2$) are used to fix images continuously onto 500 of the sheets. Each of the papers is fed in a state in which one of the short sides thereof is directed ahead. The copying speed is 50 sheets per minute.

At this time, measurements are made about the period for a preparatory heating from room temperature to the setting temperature, a change in the temperature of the sheet carrying region when the continuous copying is performed, and the maximum torque (sliding torque) of the belt.

As a result, the period for the preparatory heating from room temperature to the setting temperature is 10 seconds, Regarding the temperature change of the sheet carrying region when the continuous copying is performed, the temperature lowers at the initial stage since the sheets deprive the belt of heat abruptly. However, the belt itself generates heat, and further thermal energy is supplied from the heat generator to the belt. Thus, the fall in the surface temperature is at most 7.5° C. The copying is performed at a rate of 50 sheets per minute.

At the initial stage, after the copying is performed on 100000 of the paper sheets, and after the copying is performed on 150000 of the paper sheets, the resistance against the generation of paper wrinkles and the image quality are evaluated visually.

Examples 2 to 16

A fixing device is formed, a fixing and copying test is made, and further evaluations are made in the same way as in Example 1 except that the heat generator and the lubricant (oil) are changed to each heat generator and oil shown in Table 1. The used fluorine-based oil is an oil (trade name: DEMNAM S-200) manufactured by Daikin Industries, Ltd.

In each of Examples 9 to 16, a bilayered heat generator is used wherein the upper layer (thickness: 0.2 mm) is made of a sintered body and the lower layer (thickness: 0.3 mm) is made of a bulk metal (nonporous metal).

Comparative Example 1

Instead of the sintered metal, a bulk metal is used as a heat generator. The used heat generator is a member having a shape of a curved plate wherein from a cylinder of 30 mm in diameter with a thickness of 0.35 mm and a length of 310 mm, a portion corresponding to a central angle of 125° is cut out. The heat generator is made of a ferromagnetic carbon steel having a relative magnetic permeability of 500.

A fixing device is formed in the same way as in Example 1 except for the heat generator, and evaluation is carried out in the same manner.

The period for the preparatory heating from room temperature to the setting temperature is 11 seconds, and is about 1 second longer than in the Examples. The fall in the surface temperature of the belt in the sheet carrying region is at most 8° C. when the copying is continuously performed. The copying is performed at a rate of 50 sheets per minute.

Comparative Examples 2 to 6

A fixing device is formed in the same way as in Example 1 except that the heat generator and the lubricant (oil) are changed to each heat generator and oil shown in Table 1, a fixing and copying test is made and evaluation is carried out in the same manner.

TABLE 1

| | Heat generator | | | | | |
|---|---|---|---|---|---|---|
| | Structure | Material | Structure | Sintered density (%) | Oil species | Initial oil amount (g) |
| Example 1 | Monolayer | Fe—Ni | Sintered body | 23 | Silicone based oil | 9.0 |
| Example 2 | Monolayer | Fe | Sintered body | 35 | Silicone based oil | 8.0 |
| Example 3 | Monolayer | Ni | Sintered body | 60 | Silicone based oil | 6.5 |
| Example 4 | Monolayer | Fe—Ni | Sintered body | 85 | Silicone based oil | 5.0 |
| Example 5 | Monolayer | Fe | Sintered body | 80 | Fluorine-based oil | 5.0 |
| Example 6 | Monolayer | Ni | Sintered body | 75 | Fluorine-based oil | 5.5 |
| Example 7 | Monolayer | Fe—Ni | Sintered body | 50 | Fluorine-based oil | 7.0 |
| Example 8 | Monolayer | Fe | Sintered body | 97 | Fluorine-based oil | 4.0 |
| Example 9 | Bilayer | Fe—Ni/Al | Sintered body/bulk | 25 | Fluorine-based oil | 9.0 |
| Example 10 | Bilayer | Fe/Al | Sintered body/bulk | 70 | Fluorine-based oil | 4.0 |
| Example 11 | Bilayer | Ni/Al | Sintered body/bulk | 45 | Fluorine-based oil | 6.0 |
| Example 12 | Bilayer | Fe—Ni/Al | Sintered body/bulk | 60 | Fluorine-based oil | 5.0 |
| Example 13 | Bilayer | Fe/Cu | Sintered body/bulk | 55 | Silicone based oil | 5.5 |
| Example 14 | Bilayer | Ni/Cu | Sintered body/bulk | 50 | Silicone based oil | 6.0 |
| Example 15 | Bilayer | Fe—Ni/Cu | Sintered body/bulk | 40 | Silicone based oil | 6.5 |
| Example 16 | Bilayer | Fe/Al | Sintered body/bulk | 98 | Silicone based oil | 4.0 |
| Comparative Example 1 | Monolayer | Fe | Bulk | — | Silicone based oil | 2.0 |
| Comparative Example 2 | Monolayer | Ni | Bulk | — | Silicone based oil | 2.5 |
| Comparative Example 3 | Monolayer | Fe—Ni | Bulk | — | Fluorine-based oil | 3.0 |
| Comparative Example 4 | Bilayer | Fe/Al | Bulk | — | Fluorine-based oil | 2.5 |
| Comparative Example 5 | Bilayer | Ni/Al | Bulk | — | Fluorine-based oil | 2.0 |
| Comparative Example 6 | Bilayer | Fe—Ni/Al | Bulk | — | Silicone based oil | 3 |

The test results are shown in Table 2. Evaluating criteria about resistance against the generation of paper wrinkles and the image quality are as follows:

Resistance Against the Generation of Paper Wrinkles:

A: No paper wrinkle is generated.

B: Slight wrinkles are generated.

C: Wrinkles are generated.

Image Quality:

A: Image disturbance is not generated.

B: Image disturbance is slightly generated.

C: Image disturbance is generated.

TABLE 2

| | Results | | | | | | | | |
|---|---|---|---|---|---|---|---|---|---|
| | Initial | | | After copying on 100000 sheets | | | After copying on 150000 sheets | | |
| | Torque (N · m) | Paper wrinkle resistance | image quality | Torque (N · m) | Paper wrinkle resistance | image quality | Torque (N · m) | Paper wrinkle resistance | image quality |
| Example 1 | 0.25 | A | A | 0.25 | A | A | 0.30 | Partial image-deletion is generated. | |
| Example 2 | 0.20 | A | A | 0.25 | A | A | 0.30 | A | A |
| Example 3 | 0.30 | A | A | 0.35 | A | A | 0.40 | A | A |
| Example 4 | 0.30 | A | A | 0.50 | A | A | 0.55 | A | A |
| Example 5 | 0.35 | A | A | 0.45 | A | A | 0.50 | A | A |
| Example 6 | 0.30 | A | A | 0.40 | A | A | 0.45 | A | A |
| Example 7 | 0.25 | A | A | 0.30 | A | A | 0.35 | A | A |
| Example 8 | 0.30 | A | A | 0.55 | B | B | 0.65 | C | C |
| Example 9 | 0.25 | A | A | 0.25 | A | A | 0.30 | Partial image-deletion is generated. | |
| Example 10 | 0.30 | A | A | 0.40 | A | A | 0.45 | A | A |
| Example 11 | 0.30 | A | A | 0.30 | A | A | 0.35 | A | A |
| Example 12 | 0.35 | A | A | 0.35 | A | A | 0.40 | A | A |
| Example 13 | 0.30 | A | A | 0.35 | A | A | 0.40 | A | A |
| Example 14 | 0.20 | A | A | 0.30 | A | A | 0.35 | A | A |
| Example 15 | 0.30 | A | A | 0.30 | A | A | 0.35 | A | A |
| Example 16 | 0.30 | A | A | 0.60 | B | B | 0.70 | C | C |
| Comparative Example 1 | 0.30 | A | A | 0.75 | C | C | — | — | — |
| Comparative Example 2 | 0.30 | A | A | 0.80 | C | C | — | — | — |
| Comparative Example 3 | 0.35 | A | A | 0.90 | C | C | — | — | — |
| Comparative Example 4 | 0.35 | A | A | 0.95 | C | C | — | — | — |
| Comparative Example 5 | 0.30 | A | A | 0.85 | C | C | — | — | — |
| Comparative Example 6 | 0.20 | A | A | 0.70 | C | C | — | — | — |

* In Comparative Examples 1 to 6, the copying is not continued more than 100000 sheets.

The above has described some exemplary embodiments and examples of the invention; however, the invention is not limited thereto.

For example, the structure of each of the image forming apparatus and the image fixing device is not limited to the structures illustrated in FIGS. 1 to 3, and the structure may be appropriately modified.

For example, the surface of the heating auxiliary member which is in contact with the fixing belt is not limited to a surface made of any metal-sintered body. The contacting surface may be made of any material that has a porous structure, and may be made of, for example, a bulk metal treated by anodic oxidation so that the contacting surface of the heating auxiliary member with the fixing belt being porous structure.

The position of the heat generator (heating auxiliary member) is not limited as far as the position is a position capable of transmitting heat to the fixing belt. Thus, for example, a heating unit such as a halogen heater may be arranged inside the fixing belt.

Alternatively, the pressuring roll (second rotating body) may be autorotate thereby rotate the fixing belt (first rotating body) accompanied by the rotation of the pressuring roll. Further, each of the first and second rotating bodies may be constituted by adopting an endless belt.

About the image forming apparatus of the invention, the arrangement of its photoreceptor(s), developing member(s), the number thereof and other characteristics thereof are not limited. For example, the apparatus may be an image forming apparatus having a single photoreceptor and a single developing member.

What is claimed is:

1. An image fixing device comprising:

a tubular formed first rotating body rotatable in a circumferential direction;

a second rotating body that is arranged so that an outer circumferential surface of the second rotating body is in contact with an outer circumferential surface of the first rotating body;

a heating unit that heats the first rotating body; and a heating auxiliary member that is arranged at a portion other than a contacting portion that is between the first rotating body and the second rotating body, so as to be in contact with an inner circumferential surface of the first rotating body, at least a surface of the heating auxiliary member that is in contact with the inner circumferential surface of the first rotating body being made of a porous metal.

2. The image fixing device of claim 1, wherein the porous metal is a metal sintered body.

3. The image fixing device of claim 2, wherein the metal sintered body is composed of a metal particle that is a magnetic metallic material in which an induced current ceases to flow when the temperature of the magnetic metallic material becomes the Curie temperature or higher.

4. The image fixing device of claim 3, wherein the magnetic metallic material is a magnetic material having a relative magnetic permeability of about 100 or more.

5. The image fixing device of claim 3, wherein the magnetic metallic material is selected from the group consisting of Fe, Ni and Fe—Ni.

6. The image fixing device of claim 3, wherein the size of the metal particle is from about 0.5 μm to about 20 μm.

7. The image fixing device of claim 2, wherein the sintered density of the metal sintered body is from about 30% to about 95%.

8. The image fixing device of claim 1, wherein the heating auxiliary member is a laminate comprising a layer containing a porous metal and a layer containing a nonporous metal.

9. The image fixing device of claim 1 further comprising:

a holding member configured to support the heating auxiliary member.

10. An image forming apparatus comprising:

an image holding member;

a latent image forming unit that forms a latent image on a surface of the image holding member;

a developing unit that develops the latent image formed on the surface of the image holding member with a developing agent into a toner image;

a transferring unit that transfers the toner image developed with the developing agent on the surface of the image holding member onto a recording medium; and a fixing unit that fixes the toner image onto the recording medium, the fixing unit comprising an image fixing device comprising:

a tubular formed first rotating body rotatable in a circumferential direction;

a second rotating body that is arranged so that an outer circumferential surface of the second rotating body is in contact with an outer circumferential surface of the first rotating body;

a heating unit that heats the first rotating body; and a heating auxiliary member that is arranged at a portion other than a contacting portion that is between the first rotating body and the second rotating body, so as to be in contact with an inner circumferential surface of the first rotating body, at least a surface of the heating auxiliary member that is in contact with the inner circumferential surface of the first rotating body being made of a porous metal.

11. The image forming apparatus of claim 10, wherein the porous metal is a metal sintered body.

12. The image forming apparatus of claim 11, wherein the metal sintered body is composed of a metal particle that is a magnetic metallic material in which an induced current ceases to flow when the temperature of the magnetic metallic material becomes the Curie temperature or higher.

13. The image forming apparatus of claim 12, wherein the magnetic metallic material is a magnetic material having a relative magnetic permeability of about 100 or more.

14. The image forming apparatus of claim 12, wherein the magnetic metallic material is selected from the group consisting of Fe, Ni and Fe—Ni.

15. The image forming apparatus of claim 12, wherein the size of the metal particle is from about 0.5 μm to about 20 μm.

16. The image forming apparatus of claim 11, wherein the sintered density of the metal sintered body is from about 30% to about 95%.

17. The image forming apparatus of claim 10, wherein the heating auxiliary member is a laminate comprising a layer containing a porous metal and a layer containing a nonporous metal.

18. The image forming apparatus of claim 10, the fixing unit further comprising:

a holding member configured to support the heating auxiliary member.

* * * * *